US009003844B2

(12) United States Patent
Barraza et al.

(10) Patent No.: US 9,003,844 B2
(45) Date of Patent: Apr. 14, 2015

(54) COMBINATION LOCKS WITH IMPROVED CODE-CHANGING FEATURES

(71) Applicant: Master Lock Company LLC, Oak Creek, WI (US)

(72) Inventors: Francisco Javier Esquerra Barraza, Sonora (MX); Victor Manuel Vergara Carrizoz, Sonora (MX); Maria Dolores Ruiz Huguez, Sonora (MX); Ivan Gonzalez Ramos, Sonora (MX); Ricardo Valenzuela, Sonora (MX); Sebastian Gonzalez Zertuche, Sonora (MX)

(73) Assignee: Master Lock Company LLC, Oak Creek, WI (US)

( * ) Notice: Subject to any disclaimer, the term of this patent is extended or adjusted under 35 U.S.C. 154(b) by 224 days.

(21) Appl. No.: 13/713,254

(22) Filed: Dec. 13, 2012

(65) Prior Publication Data

US 2013/0174621 A1 Jul. 11, 2013

Related U.S. Application Data

(60) Provisional application No. 61/569,867, filed on Dec. 13, 2011.

(51) Int. Cl.

| | |
|---|---|
| ***E05B 37/00*** | (2006.01) |
| ***E05B 37/08*** | (2006.01) |
| ***E05B 65/02*** | (2006.01) |

(52) U.S. Cl.

CPC ..... *E05B 37/0058* (2013.01); *E05B 37/08* (2013.01); *E05B 37/0034* (2013.01); *E05B 65/025* (2013.01)

(58) Field of Classification Search

CPC ... E05B 37/08; E05B 65/025; E05B 37/0031; E05B 37/0058; Y10S 70/44

USPC ..... 70/284, 285, 312, 314, 315

See application file for complete search history.

(56) References Cited

U.S. PATENT DOCUMENTS

| | | | |
|---|---|---|---|
| 1,909,393 | A | 5/1933 | Diesel |
| 1,909,453 | A | 5/1933 | Brown |
| 1,937,165 | A | 11/1933 | Piagneri |
| 2,002,453 | A | 5/1935 | North |

(Continued)

OTHER PUBLICATIONS

International Search Report and Written Opinion from International Application No. PCT/US2012/069428 date of mailing Feb. 20, 2013.

(Continued)

*Primary Examiner* — Suzanne Barrett

(74) *Attorney, Agent, or Firm* — Calfee, Halter & Griswold LLP

(57) ABSTRACT

A combination locking arrangement includes a locking member, at least first and second tumbler discs, a dial, and a code change mechanism. When each of the tumbler discs is rotated to an unlocking orientation, the locking member is movable from a locking position to a releasing position. The dial is rotatable about a tumbler disc axis for selective rotation of the at least first and second tumbler discs. The dial includes a clutch rotationally securable in interlocking engagement with the first tumbler disc. The code change mechanism is rotatable to a code change position to separate the clutch from the first tumbler disc, such that the dial is subsequently rotatable to rotate the clutch with respect to the first tumbler disc.

17 Claims, 14 Drawing Sheets

(56) References Cited

U.S. PATENT DOCUMENTS

| | | | |
|---|---|---|---|
| 2,035,781 | A | 3/1936 | Bell |
| 2,047,795 | A | 7/1936 | North |
| 2,110,094 | A | 3/1938 | Pauloski et al. |
| 2,168,621 | A | 8/1939 | Lane et al. |
| 2,251,145 | A | 7/1941 | Machinist |
| 2,424,396 | A | 7/1947 | Heyer |
| 2,477,182 | A | 7/1949 | Hosking |
| 2,481,099 | A | 9/1949 | Formo et al. |
| 3,190,089 | A | 6/1965 | Foote et al. |
| 3,383,886 | A | 5/1968 | Hermann |
| 3,395,557 | A | 8/1968 | Berkowitz |
| 3,529,454 | A | 9/1970 | Fish |
| 3,572,069 | A | 3/1971 | Junkunc |
| 3,611,761 | A | 10/1971 | Atkinson |
| 3,799,594 | A | 3/1974 | Watermann |
| 3,903,718 | A | 9/1975 | Fish |
| 4,104,896 | A | 8/1978 | Hahn |
| 4,308,731 | A | 1/1982 | Remington |
| 4,325,240 | A | 4/1982 | Gable |
| 4,376,380 | A | 3/1983 | Burgess |
| 4,616,492 | A | 10/1986 | Barfield |
| 4,726,204 | A | 2/1988 | Peyronnet |
| 4,770,013 | A | 9/1988 | Nakai |
| 4,885,923 | A | 12/1989 | Nakai |
| 4,901,545 | A | 2/1990 | Bacon et al. |
| 4,910,981 | A | 3/1990 | Gartner |
| 5,113,675 | A | 5/1992 | Uyeda |
| 6,131,428 | A | 10/2000 | Wildman |
| 6,401,505 | B1 | 6/2002 | Kajuch et al. |
| 6,508,089 | B1 | 1/2003 | Tsai |
| 6,708,538 | B1 | 3/2004 | Walby |
| 6,904,778 | B2 | 6/2005 | Jasper |
| 7,266,981 | B2 | 9/2007 | Flory et al. |
| 7,984,630 | B2 | 7/2011 | Peot et al. |
| 8,459,070 | B2 * | 6/2013 | Johnson et al. ..... 70/63 |
| 2004/0182120 | A1 | 9/2004 | Flory et al. |
| 2008/0173049 | A1 | 7/2008 | Burmesch et al. |
| 2008/0209962 | A1 | 9/2008 | Peot et al. |
| 2009/0223258 | A1 | 9/2009 | Burmesch et al. |
| 2011/0209506 | A1 | 9/2011 | Johnson et al. |
| 2013/0174621 | A1 * | 7/2013 | Barraza et al. ..... 70/310 |

OTHER PUBLICATIONS

International Search Report and Written Opinion from International Application No. PCT/US2011/026421 dated Apr. 25, 2011.

* cited by examiner

COMBINATION LOCKS WITH IMPROVED CODE-CHANGING FEATURES

CROSS-REFERENCE TO RELATED APPLICATION

This application claims priority to and the benefit of U.S. Provisional Patent Application Ser. No. 61/569,867, entitled "COMBINATION LOCKS WITH IMPROVED CODE-CHANGING FEATURES" and filed Dec. 13, 2011, the entire disclosure of which is incorporated herein by reference, to the extent that it is not conflicting with the present application.

BACKGROUND

Combination locks are used in a variety of applications, including, for example, with enclosures such as lockers, cabinets, storage sheds, and various gates and doors.

While the use of a combination lock, as compared to a key based lock, may eliminate the risk of lost, stolen, or copied keys, an authorized combination may still be learned by an unauthorized user, or known by a once-authorized user to whom access is no longer desired (e.g., when a locker is assigned to a different student in a subsequent school year). In these and other circumstances, an authorized user or administrator may wish to change the unlocking combination. In a conventional dial-operated combination lock, the authorized combination code may be changed, through operation of a button or other component, to one of several optional combination codes by disengaging the dial from one or more tumbler discs of a locking mechanism, such that the rotational position of the dial with respect to the tumbler discs may be adjusted. This results in a change in the numerical positions associated with an unlocking sequence of the dial, thereby generating a new authorized combination code.

SUMMARY

In an exemplary embodiment of the present application, a combination locking arrangement includes a locking member, at least first and second tumbler discs, a dial, and a code change mechanism. When each of the tumbler discs is rotated to an unlocking orientation, the locking member is movable from a locking position to a releasing position. The dial is rotatable about a tumbler disc axis for selective rotation of the at least first and second tumbler discs. The dial includes a clutch rotationally securable in interlocking engagement with the first tumbler disc. The code change mechanism is rotatable to a code change position to separate the clutch from the first tumbler disc, such that the dial is subsequently rotatable to rotate the clutch with respect to the first tumbler disc.

Another exemplary embodiment of the present application involves a method of changing an authorized combination for a combination lock having a dial rotatable to a series of sequential rotational positions to rotate at least first and second tumbler discs to an unlocking orientation to permit movement of a locking member from a locking position to a releasing position. In the exemplary method, a code change mechanism is rotated from a locked position to a code change position to disengage the dial from the first tumbler disc. The dial is rotated with respect to the first tumbler disc to a selected one of at least first and second code selecting orientations. The code change mechanism is rotated back to the locked position to re-engage the dial with the first tumbler disc in the selected code selecting orientation for co-rotation therewith.

In still another exemplary embodiment of the present application, a locker lock includes a lock housing, a locking mechanism assembled with the lock housing, a dial secured to a front surface of the lock housing, and a code change mechanism disposed on the front surface of the lock housing. The locking mechanism includes a locking bolt laterally moveable between a locking position and a releasing position, a locking lever connected to the locking bolt, and at least first and second tumbler discs rotatable about a post. When each of the at least first and second tumbler discs is rotated to an unlocking orientation, the locking lever pivots to engage aligned recesses in the at least first and second tumbler discs, such that further rotation of the at least first and second tumbler discs moves the locking bolt from the locking position to the releasing position. The dial is operable for selective rotation of the at least first and second tumbler discs. The dial includes a drive portion rotationally secured in interlocking engagement with the first tumbler disc in one of at least first and second code selecting orientations. The code change mechanism is movable to a code change position to disengage the drive portion from the first tumbler disc, such that the dial is subsequently rotatable to rotate the drive portion with respect to the first tumbler disc to a selected one of the at least first and second code selecting orientations.

Still another exemplary embodiment of the present application involves a method of changing a combination for a combination locker lock having a dial rotatable to a series of sequential rotational positions to rotate at least first and second tumbler discs to an unlocking orientation to permit movement of a locker door from a closed position to an open position to access a locker enclosure. In the exemplary method, a code change mechanism is moved from a locked position to a code change position to disengage the dial from the first tumbler disc, with the code change mechanism being operable from outside the locker enclosure while the locker door is in the closed position. The dial is rotated with respect to the first tumbler disc to a selected one of at least first and second code selecting orientations. The code change mechanism is moved back to the locked position to re-engage the dial with the first tumbler disc in the selected code selecting orientation for co-rotation therewith.

BRIEF DESCRIPTION OF THE DRAWINGS

Further features and advantages will become apparent from the following detailed description made with reference to the accompanying drawings, wherein.

DETAILED DESCRIPTION

This Detailed Description merely describes exemplary embodiments and is not intended to limit the scope of the specification or claims in any way. Indeed, the invention as claimed is broader than and unlimited by the exemplary embodiments, and the terms used in the claims have their full ordinary meaning For example, while the specific embodiments described herein relate to combination locker locks with key operated code change mechanisms, the inventive aspects of the present application may additionally or alternatively be applied to other combination lock arrangements, including, for example, combination padlocks and combination safes, and to other code change mechanisms, including, for example, dial-operated, button-operated, and electromechanical code change mechanisms.

As used herein, unless otherwise specified, the terms "axial" and "axially" refer to a direction along (or in the direction of) a dial axis about which a dial of a combination lock rotates. The terms "lateral" and "laterally" refer to a direction perpendicular to the dial axis. The terms "radial" and "radially" refer to a direction toward or away from the dial axis.

Figure 1:
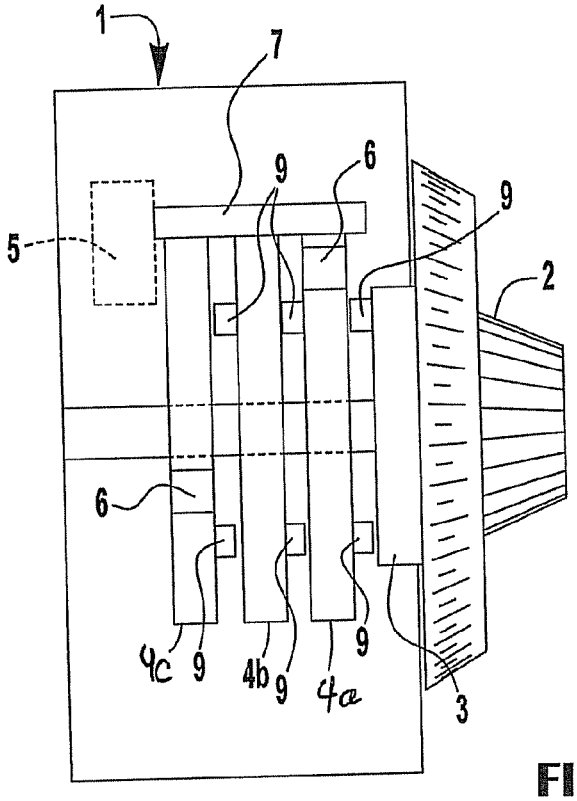
FIG. 1 PRIOR ART
FIG. 1 is a schematic side cross-sectional view of an exemplary combination lock.

The locking mechanism of a conventional single dial combination lock 1 is schematically illustrated in FIG. 1. A numbered combination dial 2, which serves as the user interface, is positioned on an external surface of the lock 1. Rotation of the dial about a dial axis causes a drive plate 3 to engage a series of rotating tumbler disc 4*a*, 4*b*, 4*c* (usually three for a conventional combination padlock or school locker lock), each having an outer periphery which holds a lever or fence 7 in a locking condition. Detents or lugs 9 extending from each of the tumbler discs 4*a*, 4*b*, 4*c* engage each other to cause the tumbler discs 4*a*, 4*b*, 4*c* to rotate together. The innermost tumbler disc 4*a* may, but need not, be rotationally fixed to the drive plate 3.

When the dial 2 is rotated to a first desired rotational position and then rotated in an opposite direction (for example, the counterclockwise direction), the outermost or third tumbler disc 4*c* remains in a desired rotational position due to separation from the detent 9 of the middle or second tumbler disc 4*b*. When the dial is then rotated to a second desired rotational position and then rotated in an opposite direction (for example, the clockwise direction), the second tumbler disc 4*b* remains in a desired rotational position due to separation from the detent 9 of the innermost or first tumbler disc 4*a*. When the dial 2 is then rotated to a third desired rotational position, the first tumbler disc 4*a* is positioned accordingly. In this fashion, the dial 2 may be rotated to successive desired positions (identifiable by alignment numbers on the dial 2, with a detent, notch, or other indicator on the lock housing) that align notches 6 in each of the tumbler discs 4*a*, 4*b*, 4*c* with the lever 7.

When all of the notches 6 are aligned with the lever 7, the lever may be permitted to move into the aligned notches 6 (for example, by user movement or by a spring loaded mechanism). In one embodiment, this lever movement may allow a locking member 5 to move out of locking engagement with a locked obstruction, such as, for example, a shackle, to allow withdrawal of the shackle. In another embodiment, engagement of the lever 7 with the aligned notches 6 may allow lateral movement of the lever 7 and a connected locking member 5 (e.g., a slideable locking bolt) by continued rotation of the combination dial 2 and the engaged tumbler discs 4*a*, 4*b*, 4*c* beyond the third successive desired rotational position, for retraction of the locking bolt to disengage a corresponding locking component (e.g., a locker frame or an interengaging latch).

Figure 4:
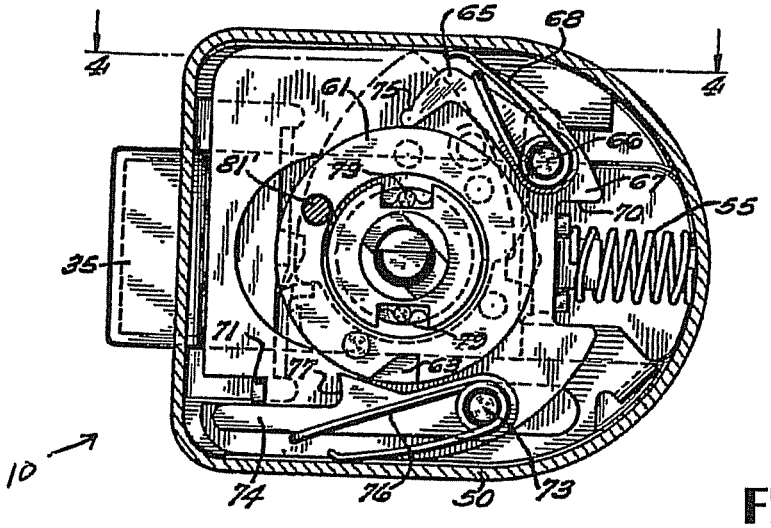
FIG. 4 PRIOR ART
FIG. 4 is a front cross-sectional view of the locker lock of FIG. 2.
Figure 5:
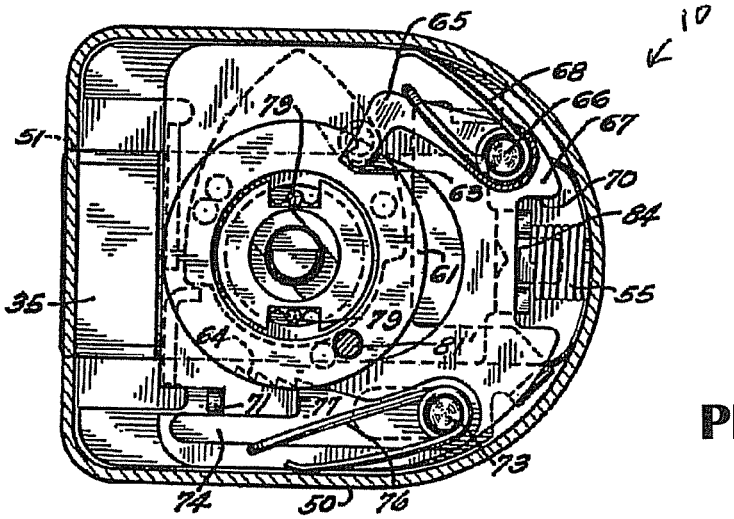
FIG. 5 PRIOR ART
FIG. 5 is a front cross-sectional view of the locker lock of FIG. 2, shown in a combination dial-operated unlocked condition.

A conventional combination locker lock having a single-dial locking arrangement and a key-operated locking arrangement is described in U.S. Pat. No. 3,190,089 (the "'089 patent"), the entire disclosure of which is incorporated by reference herein, to the extent that it is not conflicting with the present application. In this conventional combination locker lock 10, as shown in FIGS. 2-7, the dial 36 is sequentially rotatable to three successive rotational positions to rotate three tumbler discs 61, 61' (via clutch or driving portion 46) about a tumbler disc axis (which may, but need not, align with the dial axis) into unlocking orientations in which notches 63, 63' (FIGS. 4-7) in each of the discs 61, 61' align with a spring-loaded lever 65. Alignment of the notches 63, 63' allows the locking lever 65 to pivot about a pivot pin 66 (FIGS. 4-7) into engagement with the notches 63, 63'. The lever 65 is connected with a retainer plate 67, such that further rotation of the combination dial 36 beyond the third successive rotational position causes the first tumbler disc 61 to push the engaged lever 65 and retainer plate 67 (FIG. 5). The sliding movement of the retainer plate 67 in turn forces the locking bolt 35 into a retracted or releasing position, as shown in FIG. 5, to allow the locker door to be opened. When the dial 36 is released, a spring 55 forces the locking bolt 35 back to the extended or locking position (FIG. 4).

Figure 6:
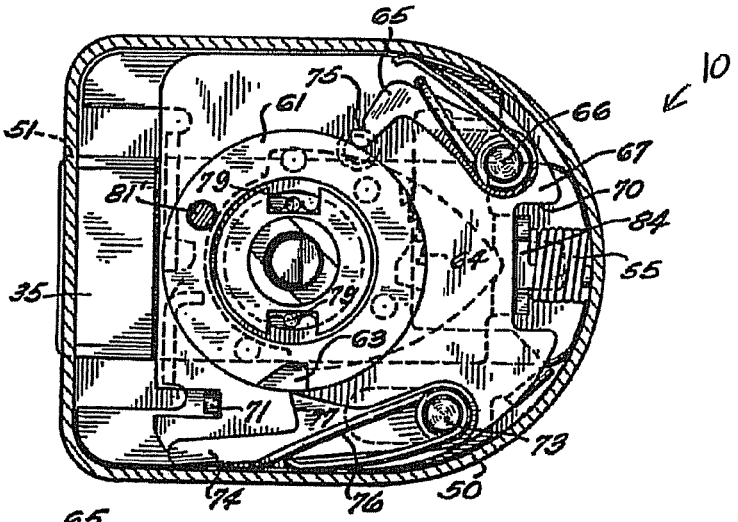
FIG. 6 PRIOR ART
FIG. 6 is a front cross-sectional view of the locker lock of FIG. 2, shown in a key-operated unlocked condition.
Figure 7:
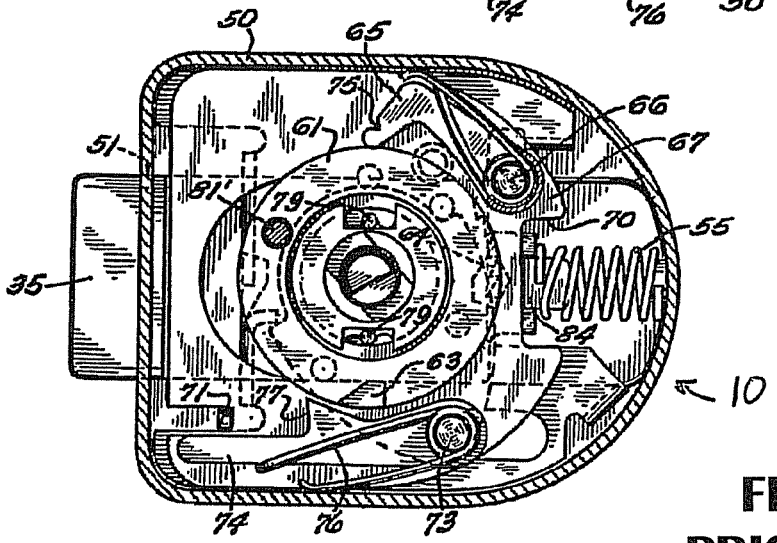
FIG. 7 PRIOR ART
FIG. 7 is a front cross-sectional view of the locker lock of FIG. 2, shown in a key-operated combination change condition.
Figure 8A:
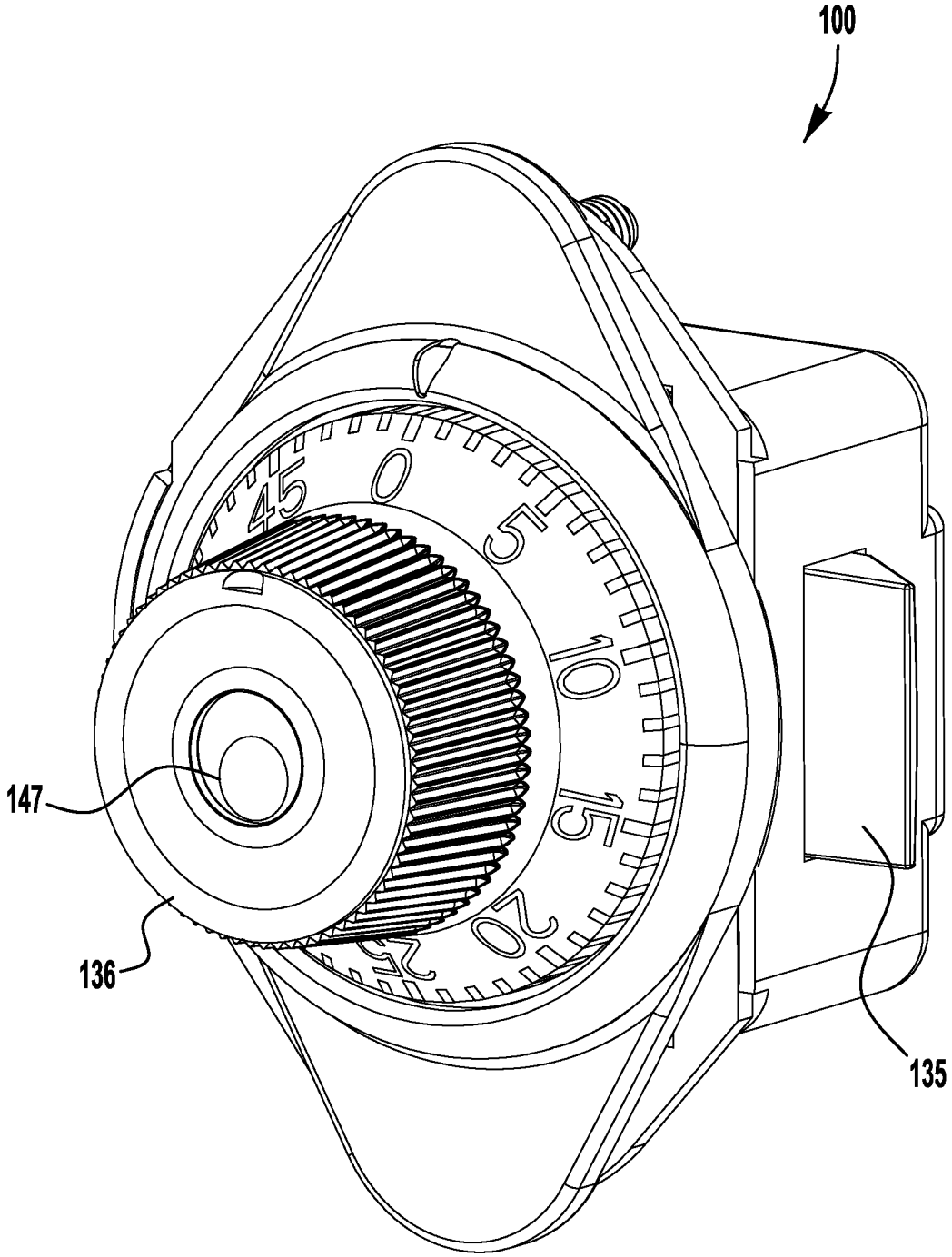
FIG. 8A is a perspective view of an exemplary combination locker lock.
Figure 8B:
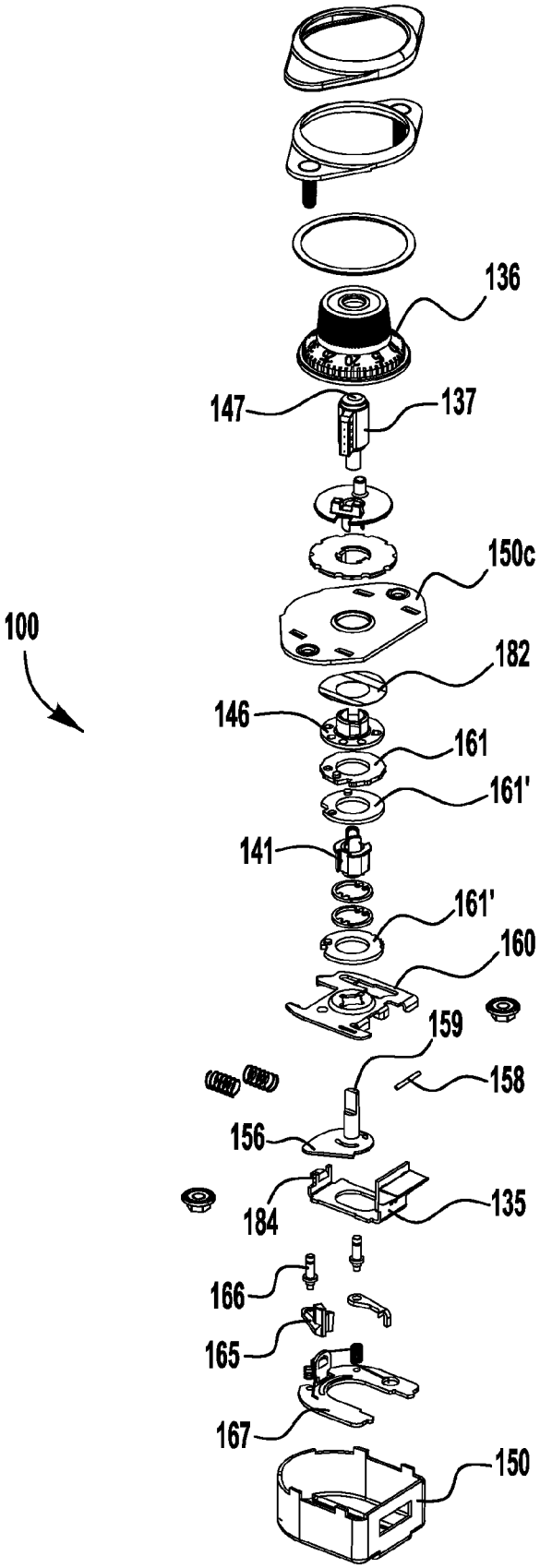
FIG. 8B is an exploded perspective view of the combination locker lock of FIG. 8A.
Figure 9A:
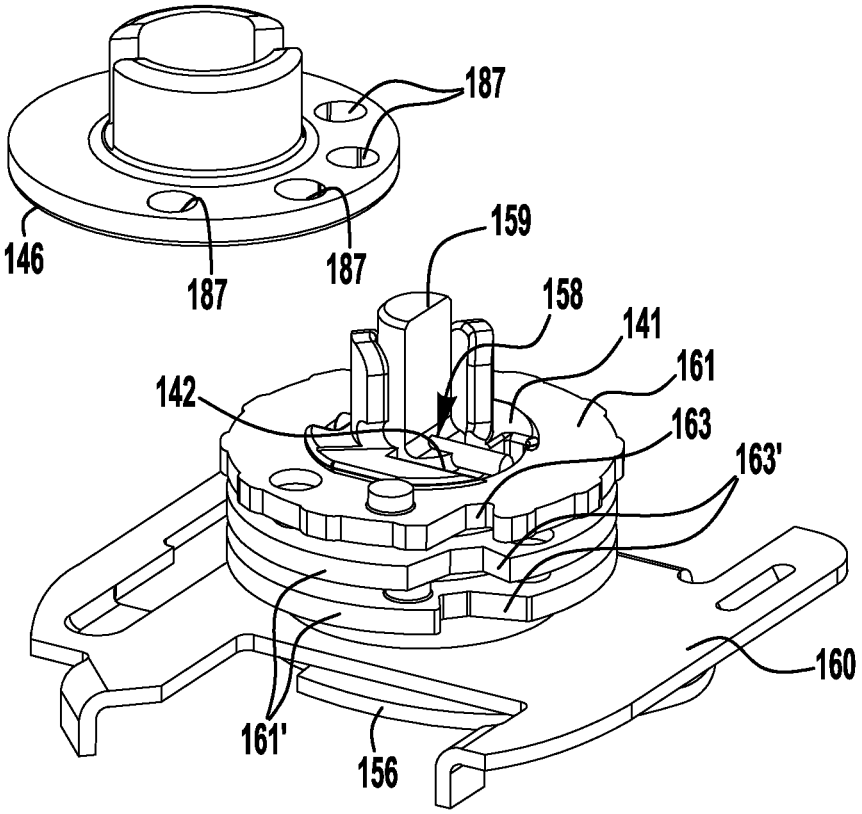
FIG. 9A is a perspective view of lock mechanism components of the combination locker lock of FIG. 8A, shown in a locked position, with the clutch plate separated to illustrate additional features of the lock mechanism.
Figure 9B:
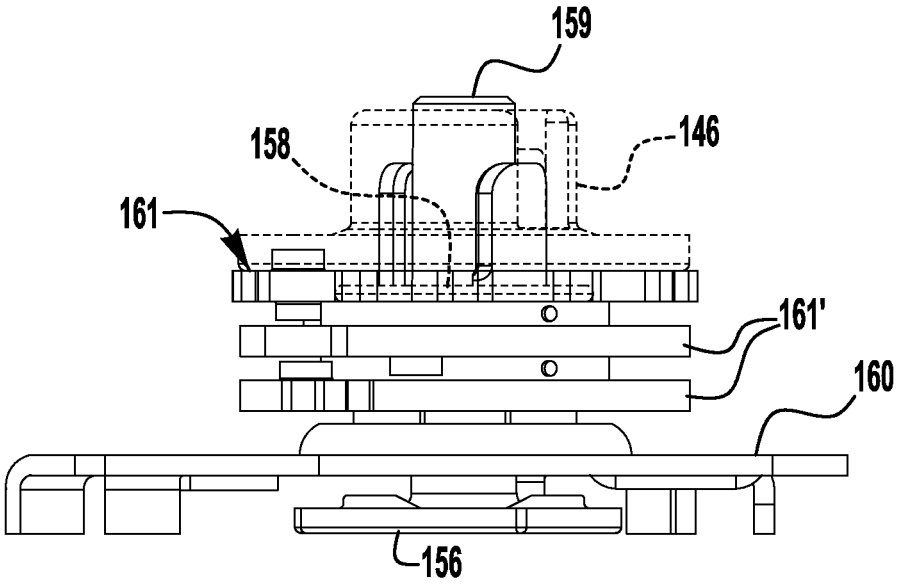
FIG. 9B is a side view of lock mechanism components of the combination locker lock of FIG. 8A, shown in a locked position, with the clutch plate shown in phantom to illustrate additional features of the lock mechanism.
Figure 10A:
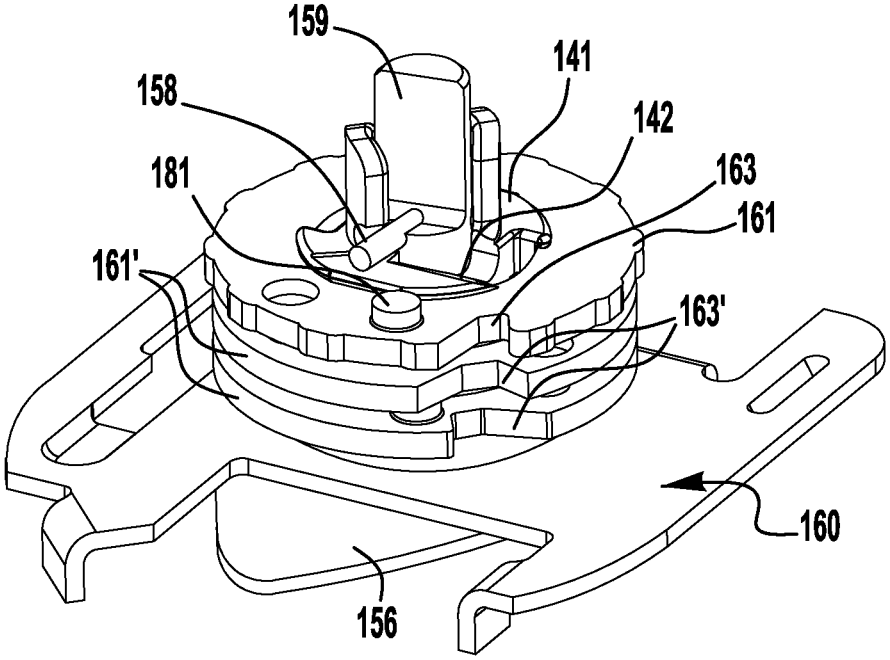
FIG. 10A is a perspective view of lock mechanism components of the combination locker lock of FIG. 8A, shown in an unlocked, code change position, with the clutch plate removed to illustrate additional features of the lock mechanism.
Figure 10B:
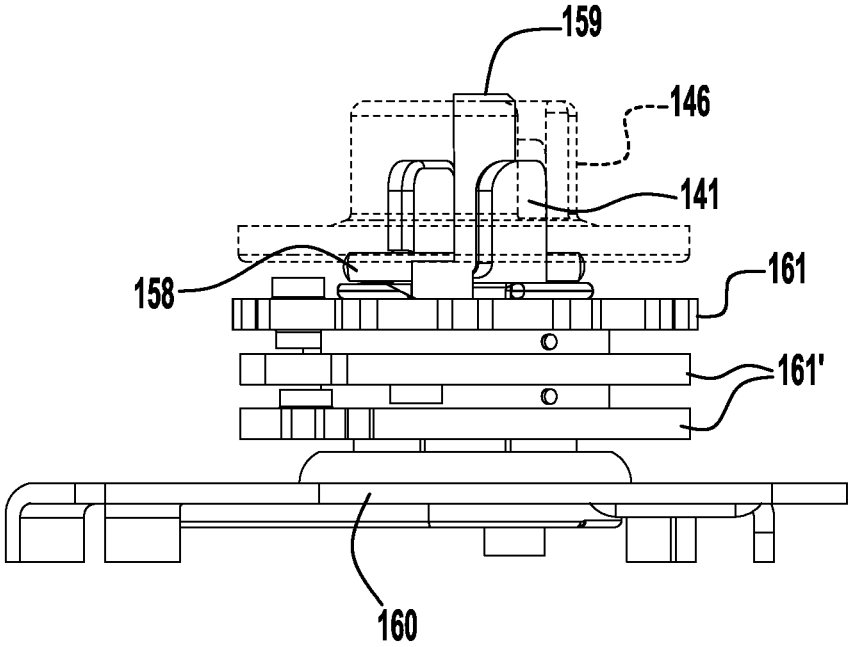
FIG. 10B is a side view of lock mechanism components of the combination locker lock of FIG. 8A, shown in an unlocked, code change position, with the clutch plate shown in phantom to illustrate additional features of the lock mechanism.

To provide for key operation of the combination locker lock 10, a conventional key cylinder lock 37 includes a plug 47 rotationally fixed to an extension 59 (FIG. 2), which is secured to a cam 56. When the plug 47 is rotated by an authorized key 49, the cam 56 rotates such that an elongated portion (shown in phantom in FIGS. 4-7) of the cam engages a flange 84 of the locking bolt 35 to move the locking bolt 35 to the retracted position (FIG. 6).

Figure 2:
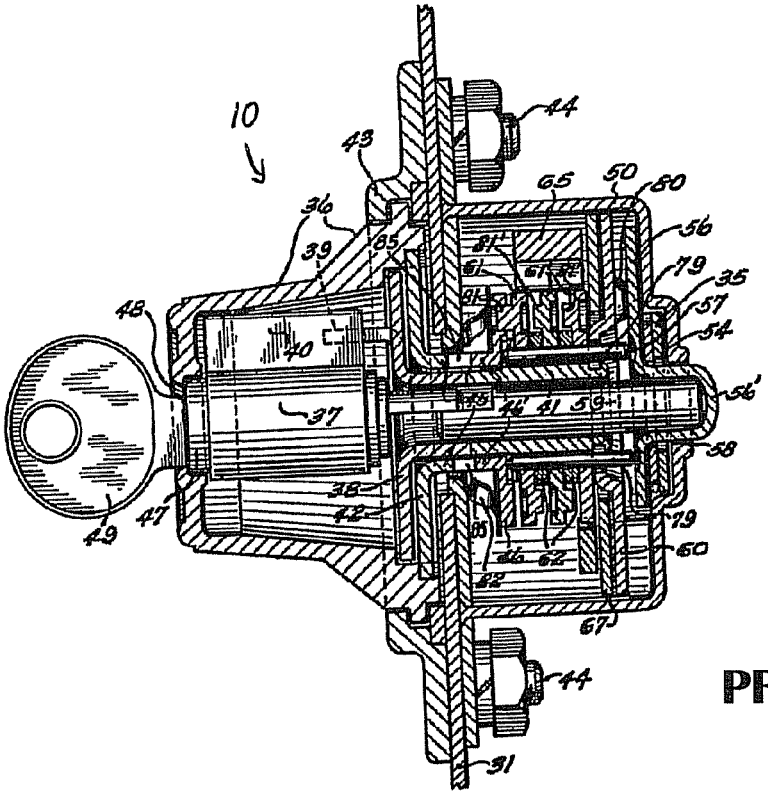
FIG. 2 PRIOR ART
FIG. 2 is a side cross-sectional view of an exemplary combination locker lock.
Figure 3:
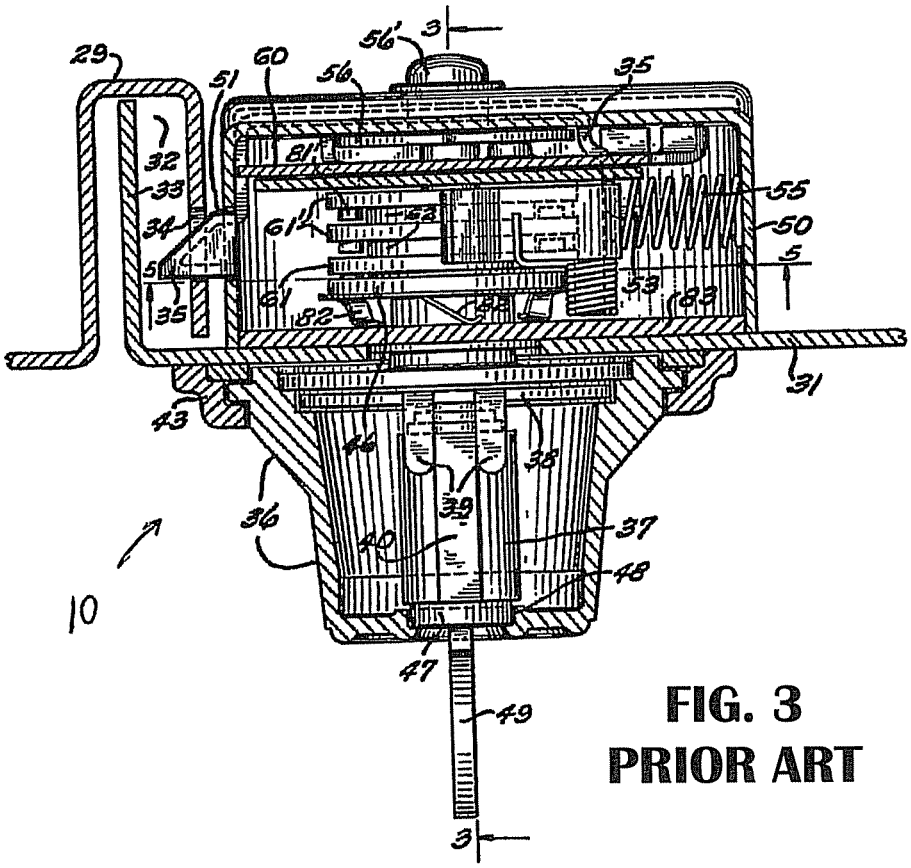
FIG. 3 PRIOR ART
FIG. 3 is a top cross-sectional view of the locker lock of FIG. 2.

To effect a combination code change of the lock 10, rotation of the key cylinder plug 47 and cam 56 beyond the unlocked position (FIG. 7) causes ramped surfaces of the cam 56 to axially raise pins 79 (FIG. 2) toward engagement with the clutch plate 46. Additionally, the elongated portion of the cam 56 is rotated out of alignment with a protuberance 80 on a bottom plate 60 within the lock (FIG. 2). This cam rotation allows a button portion 56' of the cam 56 to be pressed to axially slide the pins 79 against the clutch plate 46 and spring washer 82 (FIGS. 2 and 3) for disengagement of the clutch plate 46 from a lug 81 of the first tumbler disc 61 (FIG. 2). Subsequent rotation of the dial 36 rotates the clutch plate 46 with respect to the first tumbler disc 61 for alignment of the lug 81 with one of several apertures in the clutch plate 46. Releasing the button portion 56' with the dial and clutch plate in this new code selecting orientation causes the spring washer 82 to force the lug 81 into engagement with a new aperture in the clutch plate 46, such that different numbers on the combination dial 36 are associated with each of the successive rotational positions selected to effect unlocking alignment of the tumbler discs 61, 61'. When the key cylinder plug 47 is rotated back to the normal locked position, the spring washer 82 returns the clutch plate 46 and pins 79 to their normal positions, with the protuberance 80 aligning with the elongated portion of the cam 56 to block depression of the button portion 56'.

According to an aspect of the present application, a combination lock may be configured such that an additional or alternative mechanism may be employed to effect a combination code change of the lock, for example, to simplify code change procedures. In one embodiment, a code change mechanism may be configured to be operated by manipulation of a key cylinder lock (or other external lock mechanism) by itself, thereby allowing a separate code change button or other such component to be eliminated. When used with a combination locker lock, an external code change mechanism (e.g., a key operated code change mechanism) allows for combination changes without opening the locker door (for example, to press the code change button of a conventional combination locker lock). Further, elimination of a code change button on the lock may prevent unintended code changes, for example, by inadvertent engagement of the code change button by books or other items within a locker being compressed against the rear surface of the locker lock, on which the conventional code change button is disposed. These unintended and unknown changes to the combination code prevent the authorized user of the locker from opening the locker, and require the locker administrator to take the time to reset the locker to a known code.

While many different mechanisms may be utilized to permit combination code changes of a combination lock, in one embodiment, a key operated code change mechanism is configured to separate a dial interlocking drive portion or clutch from an endmost tumbler disc to permit reorientation of the clutch with respect to the tumbler disc. The camming mechanism may be configured to move a clutch driving member to force the clutch out of engagement with the endmost tumbler disc when the key cylinder (or other suitable user operable configuration) is rotated to a combination changing or code change position. This combination changing position may be the same as an unlocked position of the key cylinder. In other exemplary embodiments, the combination changing position may be a rotational position beyond the unlocked position of the key cylinder, or a position in an opposite rotational direction as the unlocked position from the key cylinder's locked position. For example, a lock may be configured such that a key cylinder is rotated clockwise from a locked position to unlock the lock, and counterclockwise from the locked position for a combination change.

FIGS. 8A-10B illustrate various views of an exemplary locker lock 100 adapted to provide for combination code changes upon rotation of a key cylinder lock to a combination changing position. As illustrated, most of the features and components of the exemplary embodiment may, but need not, be consistent with (and are numbered to correspond with) features and components of the conventional locker lock 10 of FIGS. 2-7, as described above and more fully described in the incorporated disclosure of the '089 patent. Additionally, most of the features and components of the exemplary embodiment may, but need not, be consistent with (and are numbered to correspond with) features and components described in co-pending U.S. Application Publication No. 2011/0209506, the entire disclosure of which is incorporated herein by reference, to the extent that it is not conflicting with the present application. As shown, the locker lock 100 may be configured to lock by engagement of a sliding locking bolt 135 with a locker frame member (as is the case with the locker lock 10 of FIGS. 2-7). In other embodiments, the locking bolt may be disposed entirely within the lock housing, and retractable from a locking position to a releasing position to disengage a rotary latch for spring-loaded rotation of the latch to an unlocked position. One example of a combination locker lock with a rotary latch is described in U.S. Pat. No. 7,984,630, entitled LOCKER LOCK, the entire disclosure of which is incorporated herein by reference, to the extent that it is not conflicting with the present application. In other lock assemblies (e.g., padlocks, cable locks, safes), a different type of locking member may be utilized.

As with the conventional combination locker lock 10 of FIGS. 2-7, the dial 136 of the exemplary lock is sequentially rotatable to three rotational positions to rotate three tumbler discs 161, 161' (via clutch 146 rotationally securable to the first tumbler disc 161, as described above) into unlocking orientations in which notches or recesses 163, 163' (FIGS. 9A, 10A) in each of the discs 161, 161', align with a spring-loaded locking lever 165 (FIG. 8B), such that the lever 165 pivots about a pivot pin 166 into engagement with the aligned notches 163, 163'. In other embodiments, a different number of tumbler discs (e.g., two, or four or more) may be provided to accommodate a combination code with a different number of dial positions.

The locking lever 165 of the exemplary lock is connected with a retainer plate 167. Further rotation of the combination dial 136 (and first tumbler disc 161) beyond the third successive rotational position causes the first tumbler disc 161 to push the engaged lever 165 and retainer plate 167. The sliding movement of the retainer plate 167 in turn forces the locking bolt 135 into a retracted or unlocked position. When the dial 136 is released, a spring 155 forces the locking bolt 135 back to the extended or locked position.

Figure 12A:
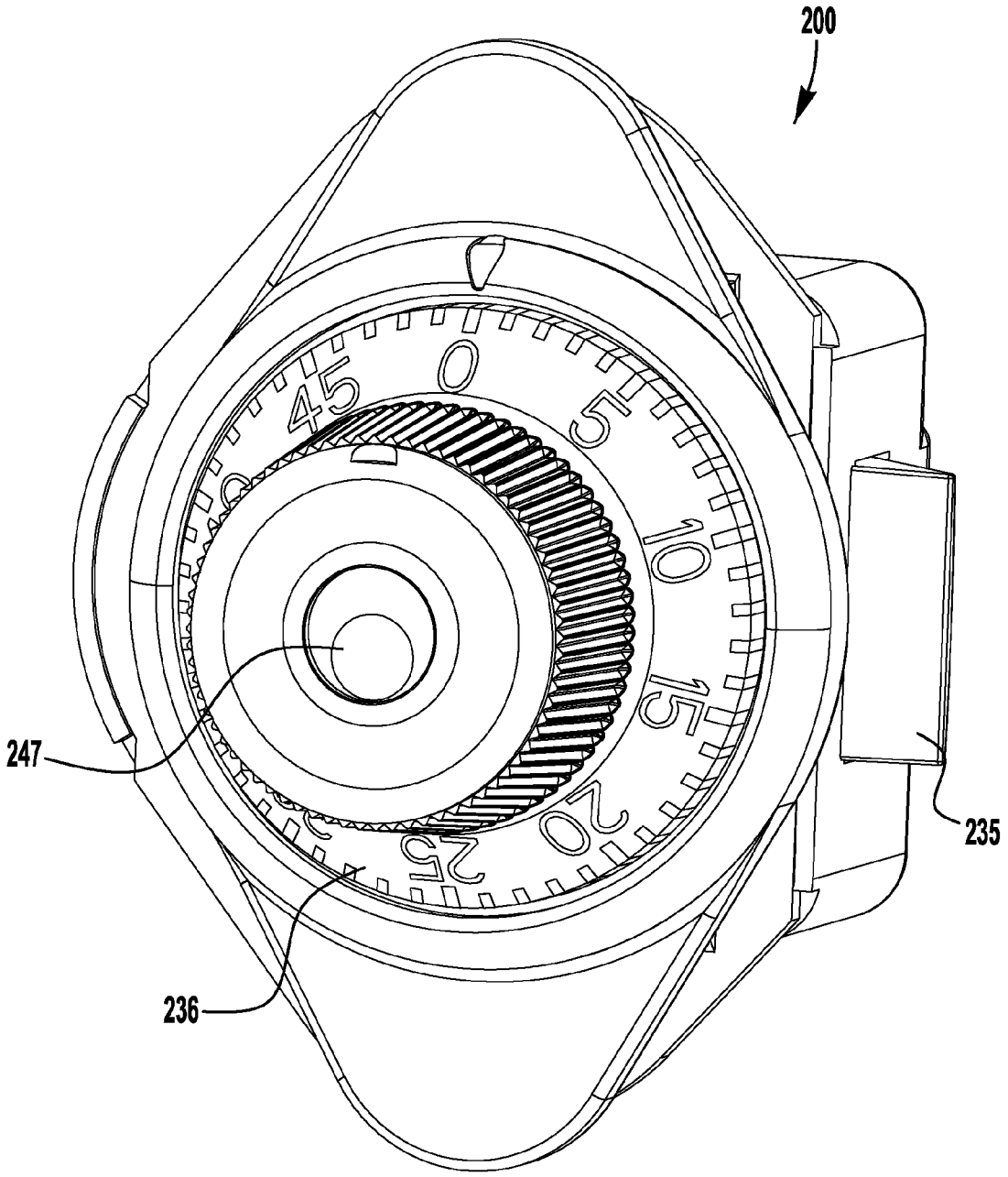
FIG. 12A is a perspective view of another exemplary combination locker lock.
Figure 12B:
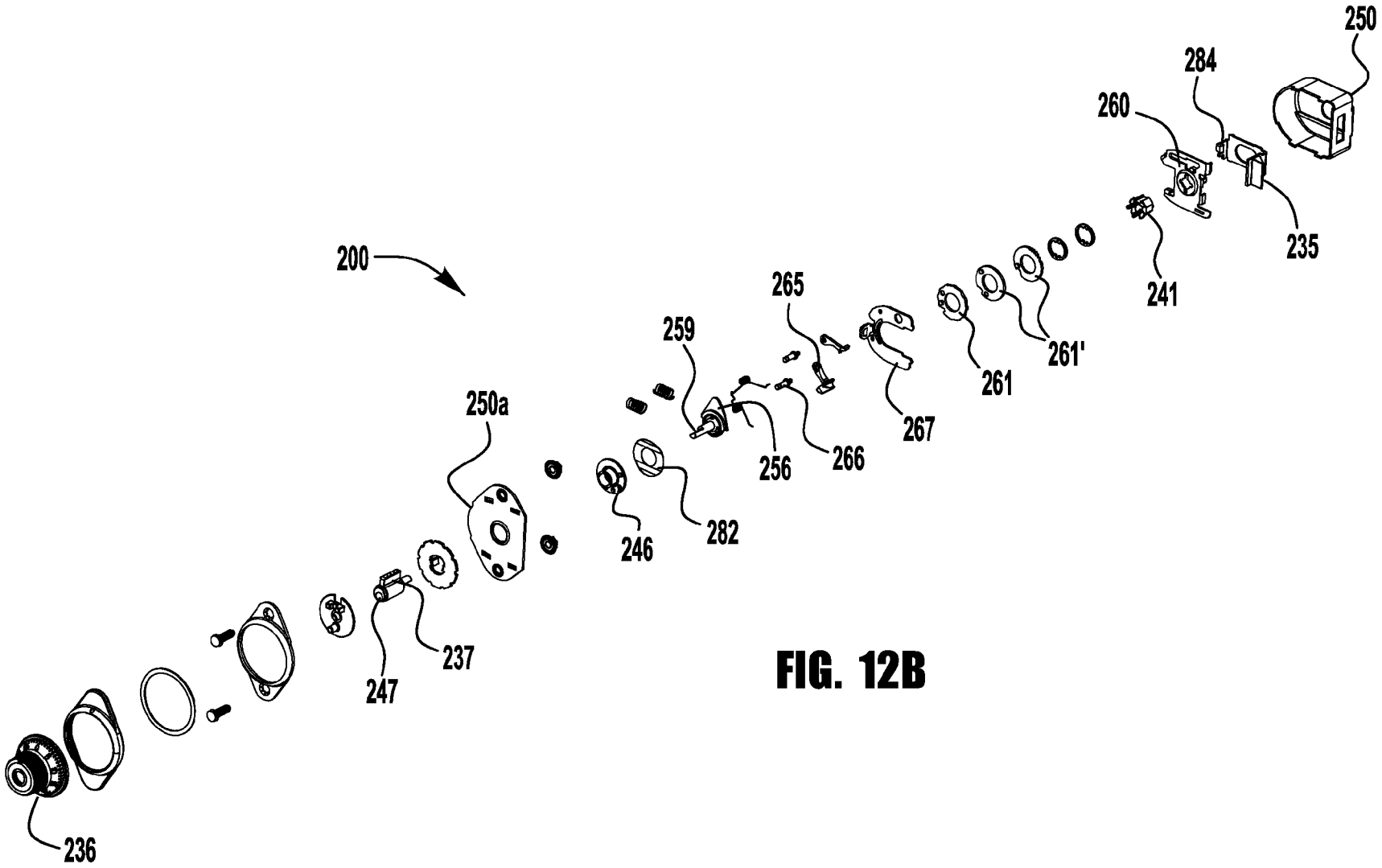
FIG. 12B is an exploded perspective view of the combination locker lock of FIG. 12A.
Figure 13A:
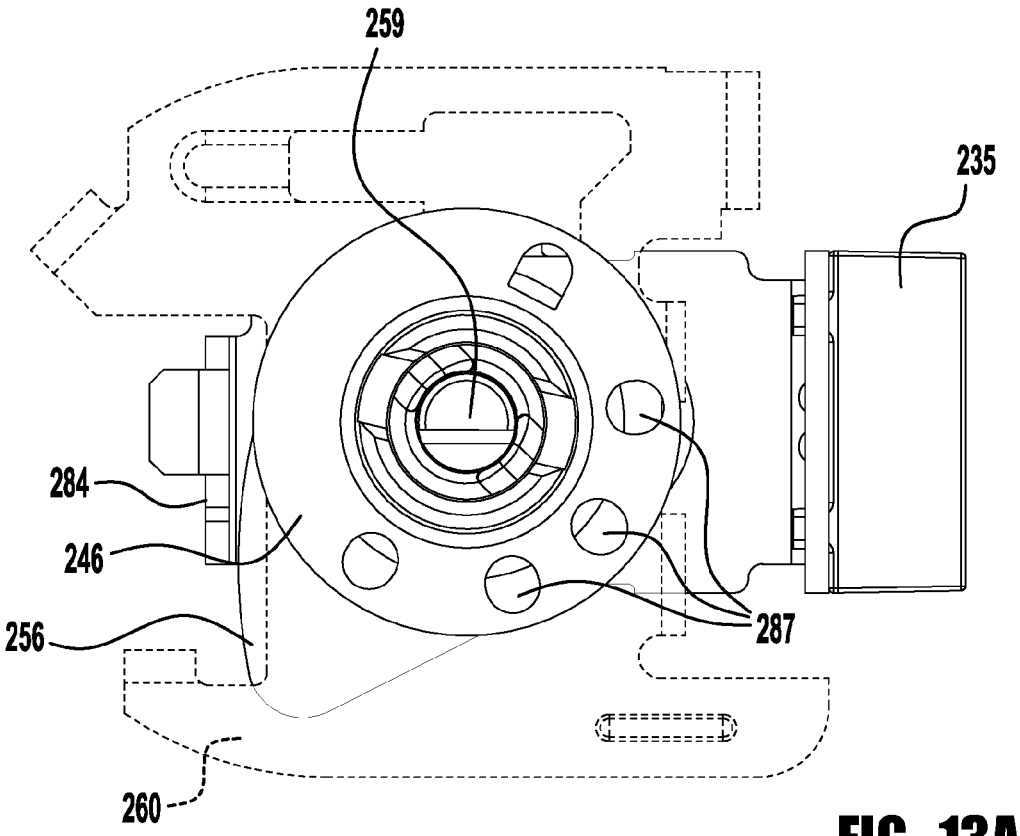
FIG. 13A is a top view of lock mechanism components of the combination locker lock of FIG. 12A, shown in a locked position.
Figure 13B:
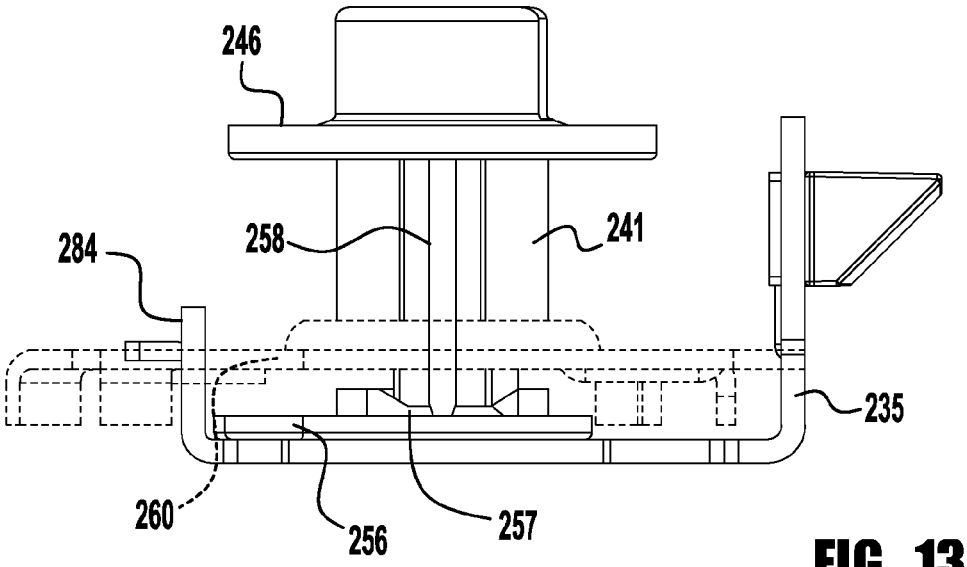
FIG. 13B is a side view of lock mechanism components of the combination locker lock of FIG. 12A, shown in a locked position.
Figure 14A:
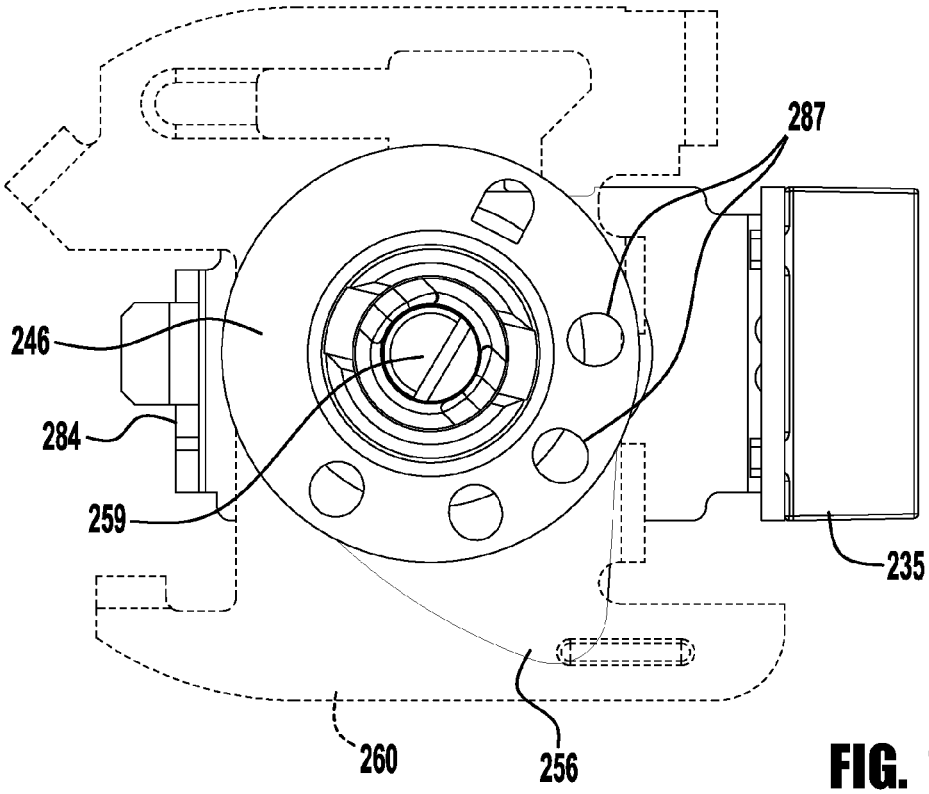
FIG. 14A is a top view of lock mechanism components of the combination locker lock of FIG. 12A, shown in a code change position.
Figure 14B:
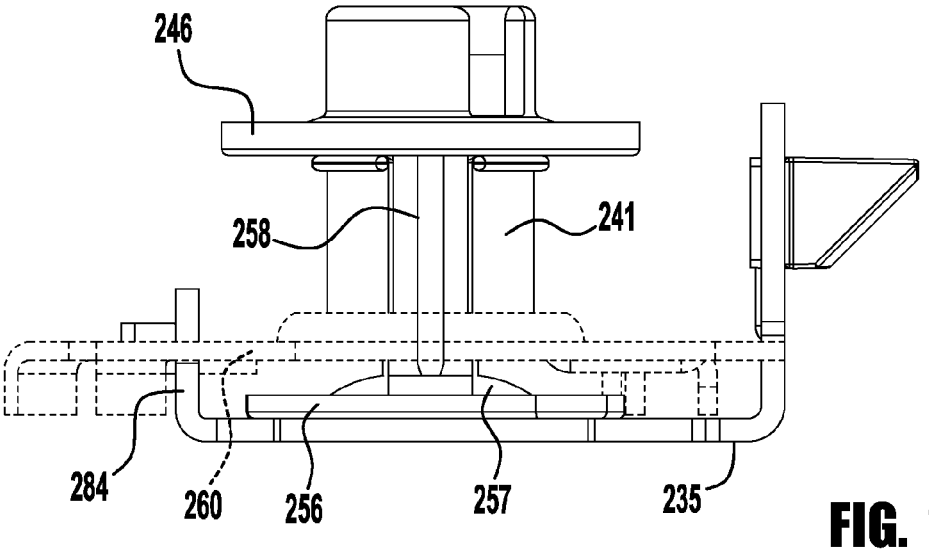
FIG. 14B is a side view of lock mechanism components of the combination locker lock of FIG. 12A, shown in a code change position.

To provide for key operation of the exemplary combination locker lock 100, a lock cylinder 137 includes a plug 147 rotationally fixed to an extension 159, which is secured to (e.g., integral with or fastened to) a cam 156. The extension 159 extends through a hollow post 141 that supports the clutch 146 and discs 161, 161'. When the plug 147 is rotated by an authorized key, the cam 156 rotates such that an elongated portion of the cam 156 (FIGS. 9 and 12) engages a flange 184 of the locking bolt 135 to move the locking bolt 135 to the releasing position.

To effect a combination code change of the exemplary lock, the lock may be provided with a code change mechanism including a clutch engaging or driving member that forces a clutch portion of the dial assembly out of engagement with the stack of tumbler discs, such that subsequent rotation of the dial re-orients the clutch portion with respect to at least one of the stack of tumbler discs. In one such embodiment, the driving member may be rotationally fixed to a rotatable code change mechanism for co-rotation with the code change mechanism. In the exemplary lock 100, the extension 159 fixed to the key cylinder plug 147 includes a clutch engaging or driving member 158 (e.g., integral or assembled with the extension) that forces the clutch 146 out of engagement with the endmost tumbler disc 161 when the cylinder plug 147 and extension 159 are rotated to a combination changing position.

Figure 11A:
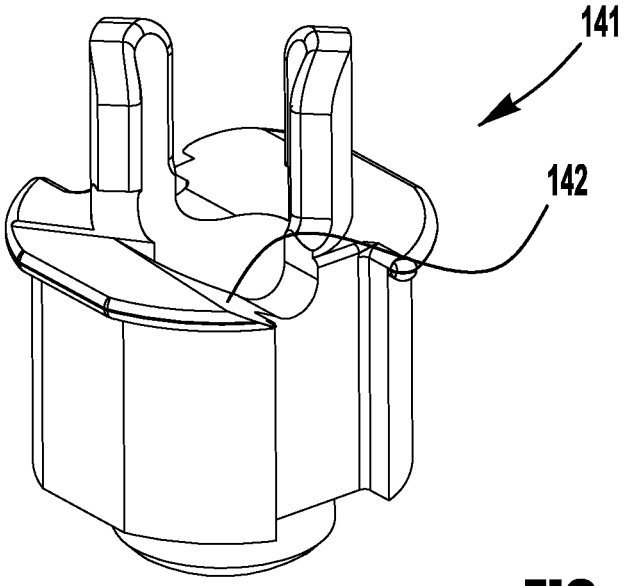
FIG. 11A is a perspective view of the clutch plate supporting post of the combination locker lock of FIG. 8A.

In the illustrated embodiment, the clutch driving member 158 includes a pin installed through the extension 159, perpendicular to the rotational axis of the extension, and received in a cavity in the post 141. The post 141 includes a substantially fixed ramped surface 142. The ramped surface 142 is contoured and positioned such that when the cylinder plug 147 and extension 159 are rotated to the combination changing position, the clutch driving member 158 rides along the ramped surface 142 to move the clutch driving member in an axial direction (and with it, the cam 156 and extension 159). This movement of the clutch driving member 158 against the clutch 146 disengages or axially separates the clutch 146 from the endmost or first tumbler disc 161. In the illustrated embodiment, the ramped surface 142 is contoured or sloped upward (i.e., toward the clutch) in the clockwise direction, such that rotation of the cylinder plug 147 and extension 159 in the clockwise direction (e.g., from the locked position to the unlocked position) disengages the clutch 146 from a lug 181 of the first tumbler disc 161. The dial 136 may then be rotated to orient the clutch 146 with respect to the first tumbler disc 161 in one of several code selection orientations, for alignment of the lug 181 with one of several corresponding apertures 187 in the clutch 146 (FIG. 11). When the key cylinder plug 147 and extension 159 are rotated back to the normal locked position, the clutch driving member 158 rides down the ramped surface 142, under the downward force of the spring washers 182 (or other suitable biasing components). This spring biasing forces the clutch 146 back into engagement with the first tumbler disc 161 in the selected code selecting orientation, with the lug 181 being received with the newly aligned aperture 187 in the clutch 146. The new code selecting orientation associates different dial indicia (e.g., numbered positions) of the dial with the unlocking orientations of the tumbler discs, thereby establishing an altered combination code.

In the illustrated embodiment, the unlocked position of the key cylinder plug 147 and extension 159 is the same orientation as the combination changing position. In other embodiments, the locked, unlocked and combination changing positions may be provided as three different rotational positions, for example, to prevent inadvertent code changes when the lock is unlocked using the key mechanism. In one such embodiment (not shown), a lock arrangement may include a key cylinder plug that is incrementally rotatable in a first direction (e.g., clockwise) from a first, locked position to a second, unlocked position (e.g., by engaging a cam with a flange portion of a locking bolt to laterally move the locking bolt to an unlocked position, as described above). The exemplary key cylinder plug may then be rotated in the first direction from the second, unlocked position to a third, combination changing position (e.g., by forcing a clutch driving member against a clutch to disengage the clutch from an endmost tumbler disc, as described). In still another embodiment (not shown), a lock arrangement may include a key cylinder plug that is incrementally rotatable in a first direction (e.g., clockwise) from a first, locked position to a second, combination changing position, and from the second, combination changing position to a third, unlocked position.

Figure 11B:
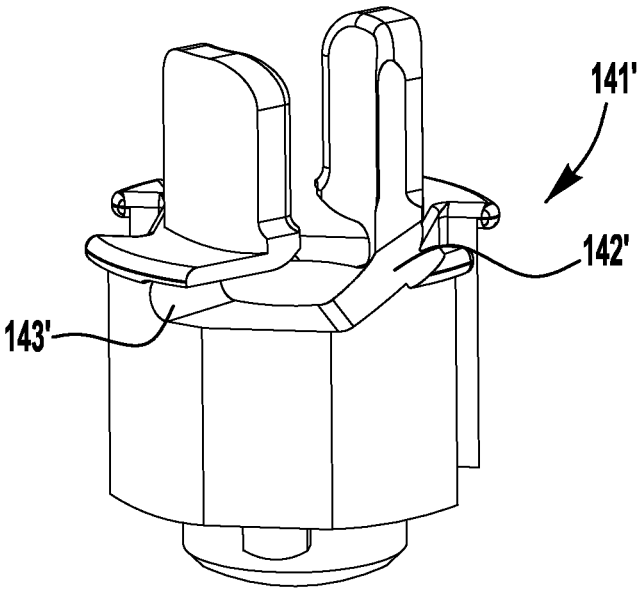
FIG. 11B is a perspective view of another exemplary clutch plate supporting post for a combination locker lock.

In yet another embodiment, a lock arrangement includes a key cylinder plug that is rotatable from a locked position in a first direction (e.g., clockwise) to an unlocking position, and in a second direction (e.g., counterclockwise) to a code change position. FIG. 11B illustrates a post 141' having a ramped surface 142' that is contoured upward in the counterclockwise direction, such that rotation of the key cylinder plug and extension (consistent with the embodiment of FIGS. 8A-10B) in the counterclockwise direction causes a clutch driving member to force the clutch out of engagement with the endmost tumbler disc. The post 141' further includes a recessed portion 143' at the base of the ramped portion 142', to provide clearance for the clutch driving member when the key cylinder plug 147 is rotated in a clockwise direction to the unlocked position.

In use, to change an authorized combination code for the exemplary combination lock 100, an authorized key (not shown) is inserted in the key cylinder plug 147, and the key cylinder plug is rotated from the normal or locked position to the code change position, causing the clutch driving member 158 to ride up the axially ramped surface 142 and engage the clutch 146, axially separating the clutch from the first tumbler disc 161. While maintaining the key cylinder plug 147 in the code change position, the dial 136 is rotated to a selected code selection position, in which the lug 181 of the first tumbler disc 161 aligns with a corresponding aperture 187 in the clutch 146. The key cylinder plug 147 is then rotated back to the normal or locked position, allowing the clutch 146 to re-engage with the first tumbler disc 161, with the lug 181 being received in the clutch aperture 187, such that the dial 136 rotates with the first tumbler disc 161 in the newly selected rotational orientation.

According to another aspect of the present application, a lock may include one or more clutch driving members that are movable in an axial direction. A rotating lock mechanism includes a camming surface configured to drive the clutch members into a clutch plate or other type of clutch to disengage the clutch from the endmost tumbler disc. Many different configurations may be used to move one or more clutch driving members in an axial direction against a clutch. In one embodiment, a locking bolt cam may include curved and ramped surfaces aligned to engage and move two or more pins when the lock mechanism is rotated to a combination changing position. The pins may be slideable in an axial direction and fixed in a lateral or radial direction with respect to the direction of rotation of the lock.

Figure 15A:
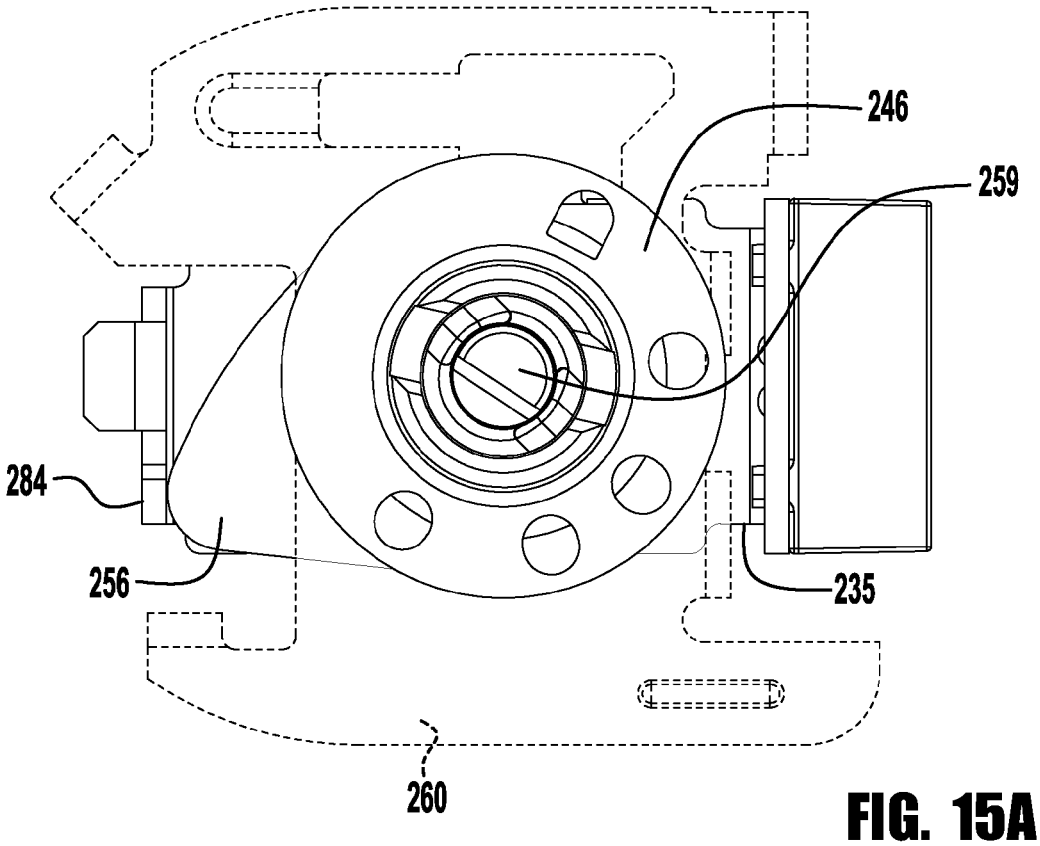
FIG. 15A is a top view of lock mechanism components of the combination locker lock of FIG. 12A, shown in an unlocked position.
Figure 15B:
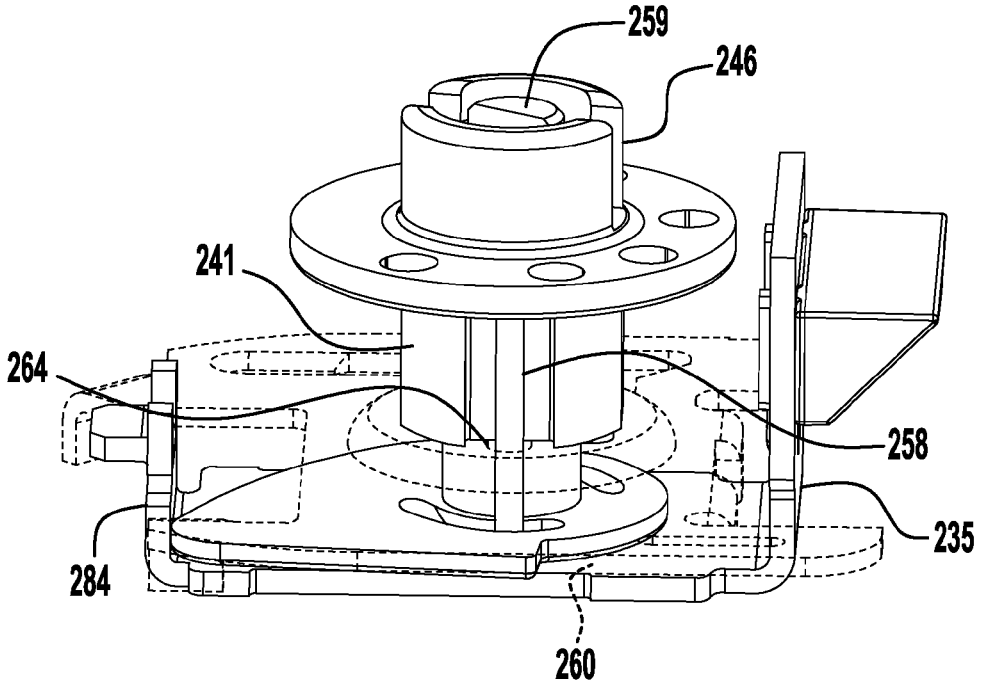
FIG. 15B is a perspective view of lock mechanism components of the combination locker lock of FIG. 12A, shown in an unlocked position.

FIGS. 12A-15B illustrate a locker lock 200 having a locking mechanism including a key cylinder 237, extension 259 and cam 256 extending through a hollow post 241. The hollow post 241 supports a clutch 246 and tumbler discs 261, 261'. The locking mechanism also includes a base plate 260 that positions a locking bolt 235 for engagement with the cam 256. Pins 258 are configured to engage the clutch 246 and extend in an axial direction between the cam 256 and the clutch 246 and through notches 264 (FIG. 15B) in the base plate 260. The cam 256 includes curved and ramped surfaces 257 (FIG. 16A) that align with the pins 258. These surfaces 257 are contoured such that rotation of the extension 259 and cam 256 toward a combination changing position causes the ramped surfaces to drive the pins 258 upward into engagement with the clutch 246 to disengage the clutch 246 from the endmost tumbler disc 261. In the illustrated embodiment, the ramped surfaces 257 are contoured or sloped upward in a clockwise direction with respect to a user's rotation of a key. Rotation of the cam 256 (by rotating the key cylinder plug 247 and extension 259) in the counterclockwise direction from a locked position (FIGS. 13A and 13B) to a combination changing position (FIGS. 14A and 14B) drives the pins 258 to disengage the clutch 246 from the endmost tumbler disc. In an exemplary embodiment, the cam 256 is shaped and oriented to engage a flanged portion 284 of the locking bolt 235 when rotated in the clockwise direction from the locked position to retract the locking bolt to an unlocked position (FIGS. 15A and 15B).

In other embodiments, a cam may be configured to effect unlocking and combination change operations using different rotations of the cam. For example, a locking mechanism may be configured to provide a combination changing position by clockwise rotation of the cam (e.g., by providing ramped surfaces that are contoured upward in a counterclockwise direction), or to provide an unlocked position by counterclockwise rotation of the cam (e.g., by positioning the cam to extend past the opposite side of the locking bolt flange). As another example, a locking mechanism may be simultaneously placed in unlocked and combination changing positions by clockwise or counterclockwise rotation of the cam (e.g., by orienting a ramped surface on the cam to drive clutch engaging pins as the cam engages the locking bolt flange). In still other embodiments, a locking mechanism may be incrementally placed in unlocking and combination changing positions by incremental first and second clockwise or counterclockwise rotations of the cam from the locked position. These incremental operations may be provided, for example, by orienting a ramped surface of the cam to drive clutch engaging pins after the cam drives the locking bolt to the unlocked position. Alternatively, a cam may be oriented to engage the locking bolt flange after the ramped surfaces drive the clutch engaging pins to disengage the clutch plate from the endmost tumbler disc.

Figure 16A:
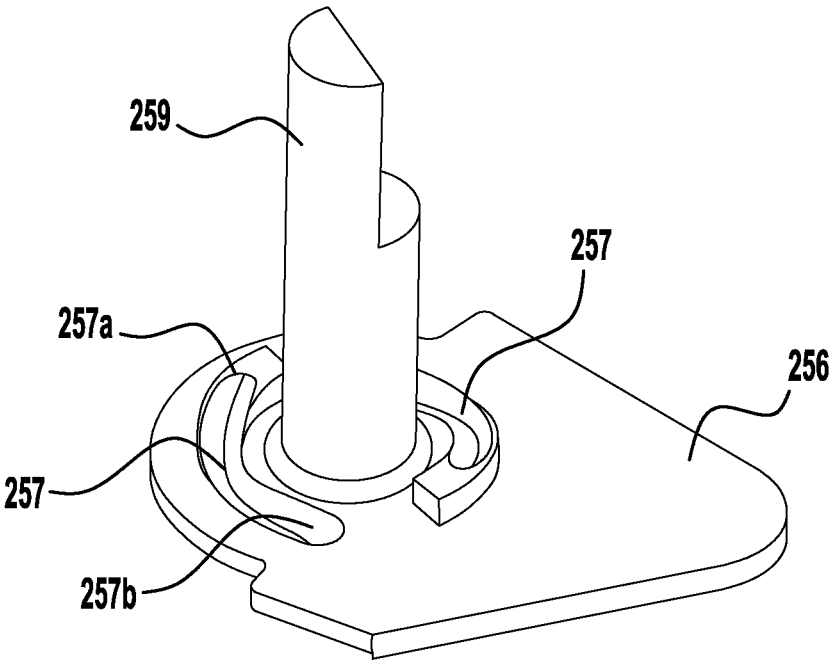
FIG. 16A is a perspective view of the extension and cam of the combination locker lock of FIG. 12A.
Figure 16B:
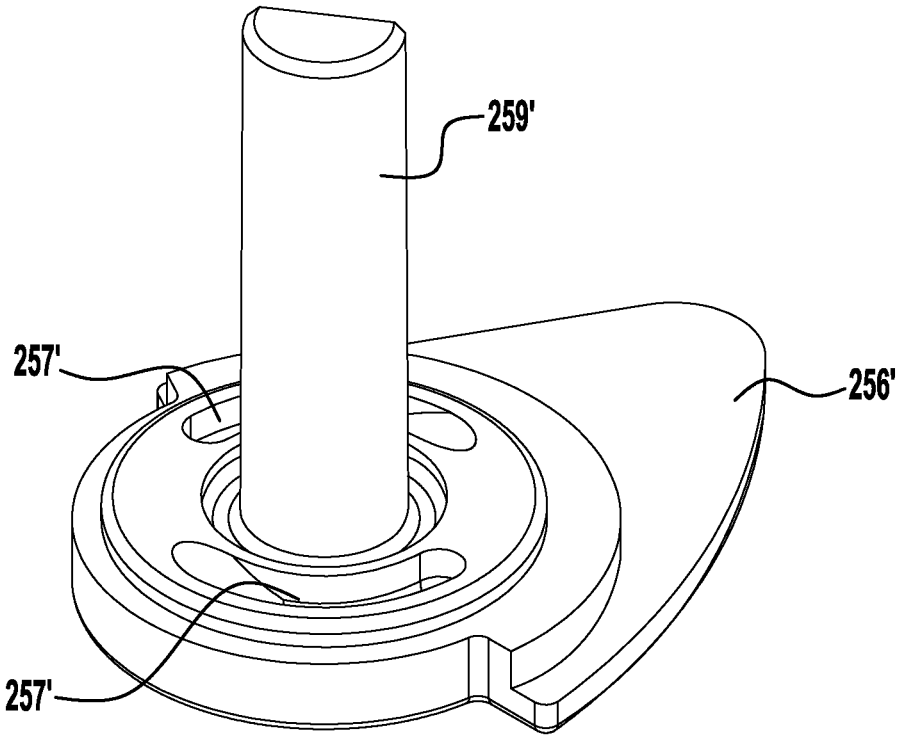
FIG. 16B is a perspective view of another exemplary clutch extension and cam for a combination locker lock.

The ramped surfaces on the cam may take many different forms. In the illustrated embodiment, the ramped surfaces 257 include an upper portion 257*a* that extends above an upper face of the cam 256 and a lower portion 257*b* that is recessed into the upper face of the cam (FIG. 16A). In another embodiment, as shown in FIG. 16B, the entire ramped surface 257' may be recessed into the upper face of the cam 256'. This configuration may provide additional support and guidance for the clutch plate engaging pins.

While various inventive aspects, concepts, features, and combinations of the inventions may be described and illustrated herein in the exemplary embodiments, these various aspects, concepts and features may be used in many alternative embodiments, either individually or in various combinations and sub-combinations thereof Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A combination locking arrangement comprising:

a locking member moveable between a locking position and a releasing position;

at least first and second tumbler discs rotatable about a tumbler disc axis, wherein when each of the at least first and second tumbler discs is rotated to an unlocking orientation, the locking member is movable from the locking position to the releasing position;

a dial rotatable about the tumbler disc axis for selective rotation of the at least first and second tumbler discs, the dial including a clutch rotationally securable in interlocking engagement with the first tumbler disc; and a code change mechanism, including a cam rotatable between separate locked, unlocked, and code change positions independent of the orientation of each of the at least first and second tumbler discs, and a driving member having a cam engaging portion that rides on an arcuate track of the cam when the cam is rotated between the locked, unlocked, and code change positions;

wherein when the cam is rotated to the unlocked position, the cam moves the locking member from the locking position to the releasing position; and wherein when the cam is rotated to the code change position, a ramped portion of the arcuate track axially moves the driving member against the clutch thereby axially separating the clutch from the first tumbler disc, such that the dial is subsequently rotatable to rotate the clutch with respect to the first tumbler disc.

2. The arrangement of claim 1, wherein the locking member comprises a laterally movable locking bolt.

3. The arrangement of claim 1, further comprising a locking lever connected to the locking member, wherein when each of the at least first and second tumbler discs is rotated to an unlocking orientation, the locking lever engages aligned recesses in the at least first and second tumbler discs, such that further rotation of the dial drives the locking lever to move the locking member from the locking position to the releasing position.

4. The arrangement of claim 1, wherein the cam is rotatable in a first direction from a locked position to the unlocked position, and rotatable in a second direction opposite the first direction from the locked position to the code change position.

5. The arrangement of claim 1, wherein the arcuate track is fixed and the driving member is rotatable with the cam to ride along the arcuate track.

6. The arrangement of claim 1, wherein the driving member is laterally fixed and the arcuate track is rotatable with the cam to move the driving member in an axial direction.

7. A method of changing a combination for a combination lock having a dial rotatable to a series of sequential rotational positions to rotate at least first and second tumbler discs to an unlocking orientation to permit movement of a locking member from a locking position to a releasing position, and a code change mechanism having a cam rotatable between separate locked, unlocked, and code change positions, and a driving member that rides on an arcuate track of the cam when the cam is rotated between the locked, unlocked, and code change positions, the method comprising:

rotating the cam from the locked position to the code change position, such that a ramped portion of the arcuate track axially moves the driving member against the dial to disengage the dial from the first tumbler disc;

rotating the dial with respect to the first tumbler disc to a selected one of at least first and second code selecting orientations;

rotating the cam back to the locked position to re-engage the dial with the first tumbler disc in the selected code selecting orientation for co-rotation therewith.

8. The method of claim 7, wherein rotating the cam from the lock position to the code change position comprises rotating the driving member to ride along the arcuate track, the arcuate track being substantially fixed within the combination lock.

9. The method of claim 7, wherein rotating the cam from the lock position to the code change position comprises rotating the arcuate track, the driving member being laterally fixed within the combination lock.

10. The method of claim 7, wherein the combination lock comprises a locker lock operable to permit movement of a locker door from a closed position to an open position to access a locker enclosure, wherein the cam is moved from the locked position to the code change position from outside the locker enclosure while the locker door is in the closed position.

11. A locker lock comprising:

a lock housing;

a locking mechanism assembled with the lock housing, the locking mechanism comprising a locking bolt laterally moveable between a locking position and a releasing position, a locking lever connected to the locking bolt, and at least first and second tumbler discs rotatable about a post, wherein when each of the at least first and second tumbler discs is rotated to an unlocking orientation, the locking lever pivots to engage aligned recesses in the at least first and second tumbler discs, such that further rotation of the at least first and second tumbler discs moves the locking bolt from the locking position to the releasing position;

a dial secured to a front surface of the lock housing for selective rotation of the at least first and second tumbler discs, the dial including a drive portion rotationally secured in interlocking engagement with the first tumbler disc in one of at least first and second code selecting orientations; and a code change mechanism, disposed on the front surface of the lock housing, the code change mechanism including a cam rotatable between separate locked, unlocked, and code change positions independent of the orientation of each of the at least first and second tumbler discs, and a driving member having a cam engaging portion that rides on an arcuate track of the cam when the cam is rotated between the locked, unlocked, and code change positions;

wherein when the cam is rotated to the unlocked position, the cam moves the locking member from the locking position to the releasing position; and wherein when the cam is rotated to the code change position, a ramped portion of the arcuate track axially moves the driving member against the drive portion thereby axially separating the drive portion from the first tumbler disc, such that the dial is subsequently rotatable to rotate the drive portion with respect to the first tumbler disc to a selected one of the at least first and second code selecting orientations.

12. The locker lock of claim 11, wherein the code change mechanism comprises a key cylinder lock rotatable to rotate the cam.

13. The locker lock of claim 11, wherein the cam is rotatable in a first direction from the locked position to the unlocked position, and rotatable in a second direction opposite the first direction from the locked position to the code change position.

14. The locker lock of claim 11, wherein the arcuate track is fixed and the driving member is rotatable with the cam to ride along the arcuate track.

15. The locker lock of claim 11, wherein the driving member is laterally fixed and the arcuate track is rotatable with the cam to move the driving member in an axial direction.

16. A method of changing a combination for a combination locker lock having a dial rotatable to a series of sequential rotational positions to rotate at least first and second tumbler discs to an unlocking orientation to permit movement of a locker door from a closed position to an open position to access a locker enclosure, and a code change mechanism having a cam rotatable between separate locked, unlocked, and code change positions, and a driving member that rides on an arcuate track of the cam when the cam is rotated between the locked, unlocked, and code change positions, the method comprising:

moving the code change mechanism to rotate the cam from the locked position to the code change position, such that a ramped portion of the arcuate track axially moves the driving member against the dial to disengage the dial from the first tumbler disc, the code change mechanism being operable from outside the locker enclosure while the locker door is in the closed position;

rotating the dial with respect to the first tumbler disc to a selected code orientation;

moving the code change mechanism to rotate the cam back to the locked position to re-engage the dial with the first tumbler disc in the selected code orientation.

17. The method of claim 16, wherein the code change mechanism is moved from a locked position to a code change position without pressing a button.

* * * * *